US006364643B1

(12) United States Patent
Milliff

(10) Patent No.: US 6,364,643 B1
(45) Date of Patent: Apr. 2, 2002

(54) SCROLL COMPRESSOR WITH DUAL SUCTION PASSAGES WHICH MERGE INTO SUCTION PATH

(75) Inventor: Tracy L. Milliff, Bristol, VA (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/709,957

(22) Filed: Nov. 10, 2000

(51) Int. Cl.[7] ..... F03C 2/00
(52) U.S. Cl. ..... 418/15; 418/55.1
(58) Field of Search ..... 418/15, 55.1

(56) References Cited

U.S. PATENT DOCUMENTS 4,696,628 A 9/1987 Kimura et al.
4,815,951 A 3/1989 Kakuda et al.
4,854,831 A 8/1989 Etemad et al.
5,253,489 A 10/1993 Yoshii
5,295,808 A * 3/1994 Machida et al. ..... 418/15
6,027,321 A * 2/2000 Shim et al. ..... 418/55.1
6,071,100 A * 6/2000 Yamada et al. ..... 418/55.6
6,270,328 B1 * 8/2001 Herbert et al. ..... 418/55.1

FOREIGN PATENT DOCUMENTS

JP 63-259103 A * 10/1988 ..... 418/55.1
JP 05-263775 A * 10/1993 ..... 418/55.1
JP 10-288173 A * 10/1998 ..... 418/55.1

* cited by examiner

*Primary Examiner*—Thomas Denion
*Assistant Examiner*—Theresa Trieu
(74) *Attorney, Agent, or Firm*—Carlson, Gaskey & Olds

(57) ABSTRACT

An improved scroll compressor having a full thrust surface at which a face of the non-orbiting scroll is in contact with the base of the orbiting scroll is provided with two suction passages. The suction passages extend along circumferential directions at which a substantial portion of the direction of the suction port is tangential. The two suction passages are circumferentially spaced to each be associated with independent compression chambers within the scroll compressor. Due to the tangential component, the refrigerant leaving the ports tends to merge into the compression chambers more rapidly. This results in improved flow, and a reduction in heat transfer.

6 Claims, 2 Drawing Sheets

SCROLL COMPRESSOR WITH DUAL SUCTION PASSAGES WHICH MERGE INTO SUCTION PATH

BACKGROUND OF THE INVENTION

This application relates to a scroll compressor with two inlet ports which merge into a suction path leading to the compressing chambers.

Scroll compressors are widely utilized in refrigerant compression applications. Scroll compressors include a first scroll member having a base and a generally spiral wrap extending from the base. A second scroll member has a base and a generally spiral wrap extending from its base. The two spiral wraps interfit to define compression chambers. The second scroll member is driven to orbit relative to the first scroll member.

In one type scroll compressor, the base of the second scroll member is in contact with an outer face of the first scroll member at locations radially outwardly of the spiral wraps. This scroll compressor type is known as a full thrust surface scroll compressor. In such scroll compressors, typically there has been a single suction port for providing a refrigerant into the compression chambers. Some scroll compressors have utilized dual suction ports, however, these ports have typically extended through an intermediate portion in the first scroll member, and not at the thrust face.

In full thrust surface scroll compressors, there have typically not been two suction paths leading to the compression chambers. In one proposed scroll compressor there have been two suction paths leading to the compression chambers through the contact face of the non-orbiting, or first scroll member. However, the suction paths have extended radially inwardly generally perpendicular towards a central axis of the scroll compressor.

One main advantage of providing a pair of suction paths into the scroll set compression chambers is that the flow from the two paths to the respective suction chambers need not travel for an undue distance. The longer the refrigerant must travel to reach the respective suction chambers, the greater the heat transfer to the refrigerant. It would be desirable to minimize this heat transfer. Thus, the prior art scroll compressors in which the suction paths lead generally perpendicular, would result in gas turbulence causing inadvertent delay in the flow of refrigerant into the compression chambers.

SUMMARY OF THE INVENTION

In the disclosed embodiment of this invention, a scroll compressor includes a non-orbiting scroll member having "full" thrust face contact with the orbiting scroll member, and in which a pair of suction ports lead through the contact face of the nonorbiting scroll to the compression chambers at two circumferentially spaced locations. Preferably, the suction paths merge into a suction chamber radially outward of the nonorbiting scroll wrap, with a component which is generally tangential to the outer periphery of the wrap. More preferably, the suction path initially begins with a smaller tangential component, and merges to a direction with a greater tangential component. In this way, the refrigerant is guided along an optimum path, and thus quickly and smoothly merges into the compression chamber, minimizing the amount of heat transfer to the refrigerant.

In more preferred embodiments of this invention, the suction path is defined within a thrust surface such that the thrust surface itself defines this curving path. This also provides improved reaction through the thrust surface in that there is not a direct radial "weak" line through the thrust surface as would be created by the prior art proposed perpendicularly extended path.

These and other features of the present invention can be best understood from the following specification and drawings, the following of which is a brief description.

DETAILED DESCRIPTION OF A PREFERRED EMBODIMENT

Figure 1:
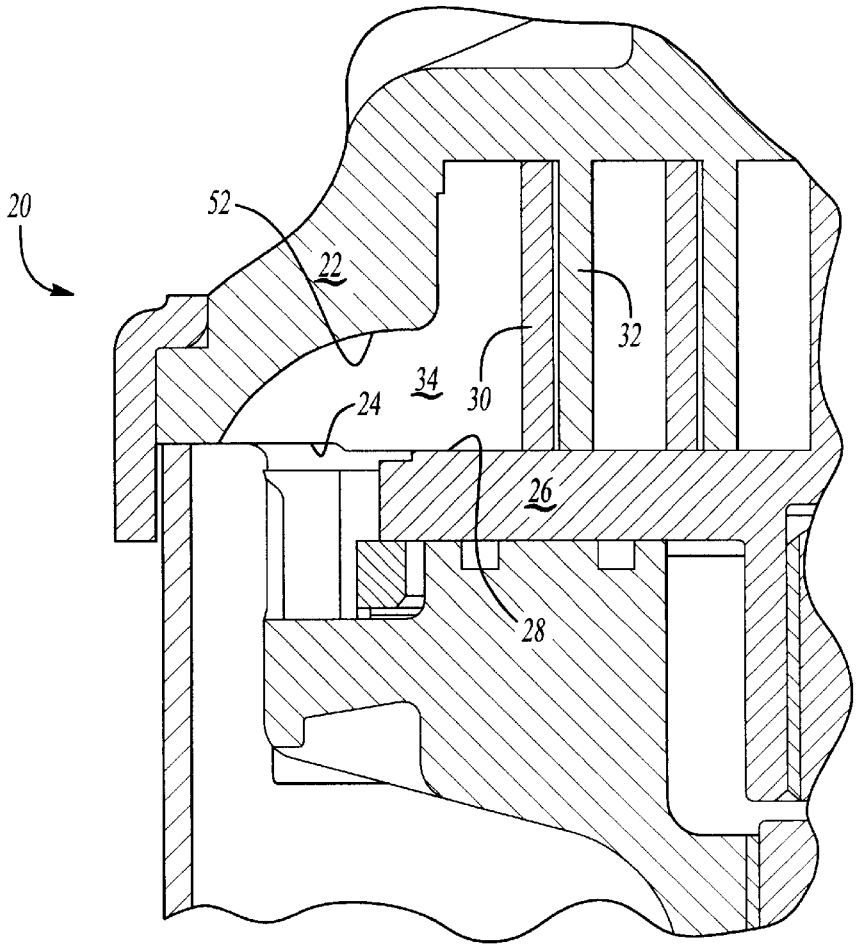
FIG. 1 is a cross-sectional view through a portion of a scroll compressor incorporating this invention.

A scroll compressor 20 is illustrated in FIG. 1 incorporating a non-orbiting scroll member 22 having an end face 24 in contact with an orbiting scroll 26 at its end face or base face 28. A wrap 30 from the orbiting scroll interfits with a wrap 32 from the non-orbiting scroll 22. A suction passage 34 extends along the contact surface between the faces 24 and 28. As can be appreciated from FIG. 2, there are a pair of suction passages 34 and 36 formed in the non-orbiting scroll 22.

Figure 2:
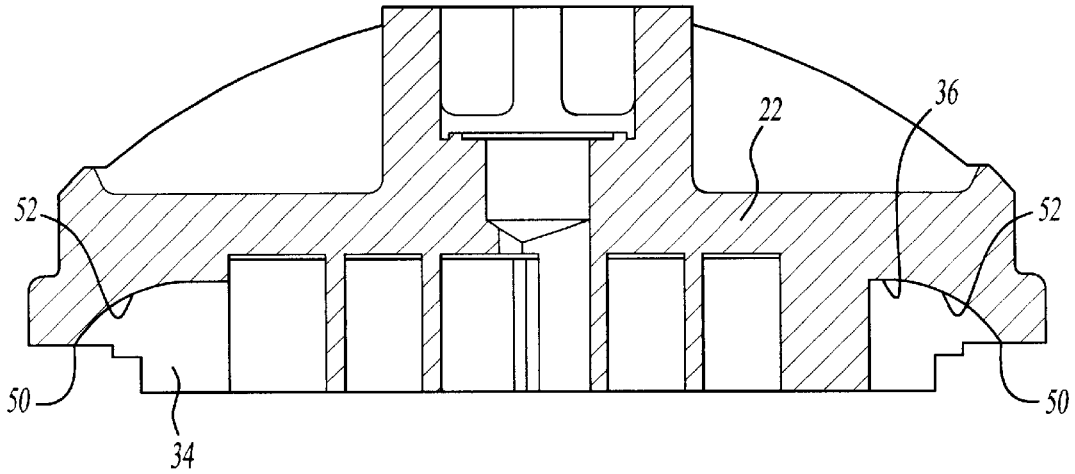
FIG. 2 shows the non-orbiting scroll according to this invention.

As can be seen in FIGS. 1 and 2, the suction passages merge from an outer location 50 at which it is relatively small to a radially inner location 52 at which it has a greater extent. Again, this assists the flow in merging into the suction passages.

Figure 3:
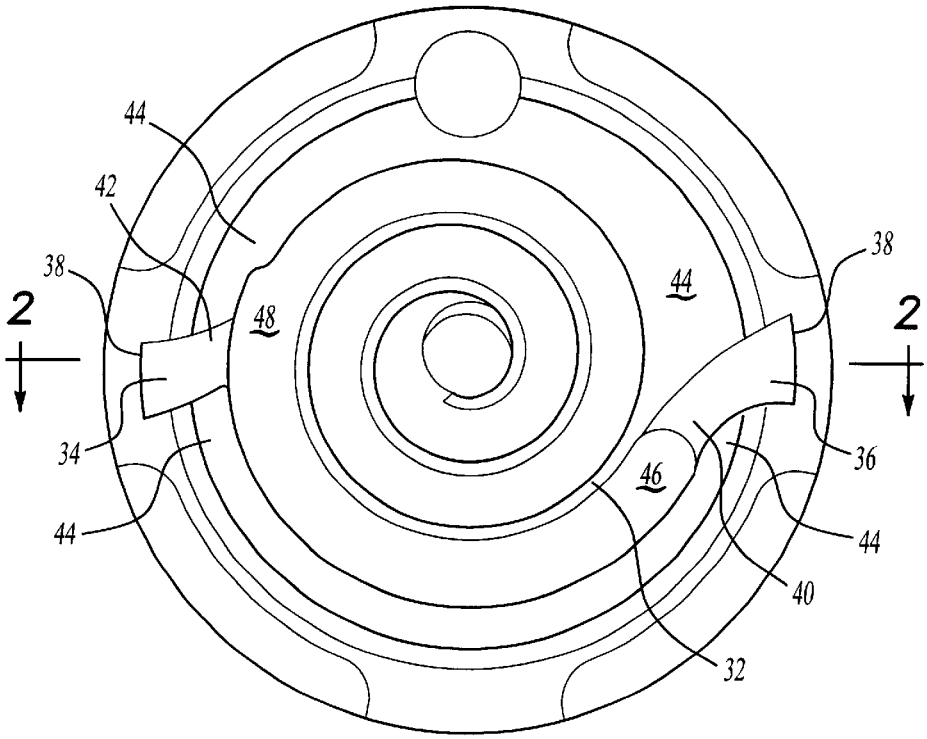
FIG. 3 is a plane view of the non-orbiting scroll according to this invention.

As shown in FIG. 3, suction passages 34 and 36 have an initial component 38 which extends along a curve generally pointing in a first direction which has a component extending radially inwardly, but also circumferentially along the outer periphery of the wrap 32. A second component 40 of each of the passages 34 and 36 has a similar shape, although to a lesser extent such that it is more tangential to the scroll than the first portion. The other inlet passage 36 has a portion 42 which tends to be generally tangential to the outer surface of the wrap 32 at its approximate circumferential location. As can be appreciated, surfaces 44 are part of the end face 24 which defines the thrust surface, and which are positioned on each circumferential side of both of passages 34 and 46. Since passages 34 and 36 do not extend generally perpendicularly inwardly, the flow through the passages reaches the suction chambers 46 and 48, respectively, extending in a generally more optimum direction to flow into the compression chambers. As is known, a compression chamber is defined adjacent each of the portions 46 and 48. The flow from passages 34 and 36 is more properly orientated in that the flow is tending to move in the right direction as it enters the suction areas 46 and 48. Thus, the present invention improves upon the prior art. Moreover, since the break in the thrust surface is not along a perpendicularly straight line, there is no portion of the thrust surface which would be a "broken" area such as would be the case with the proposed prior art. As such, the present invention provides better support.

Figure 4:
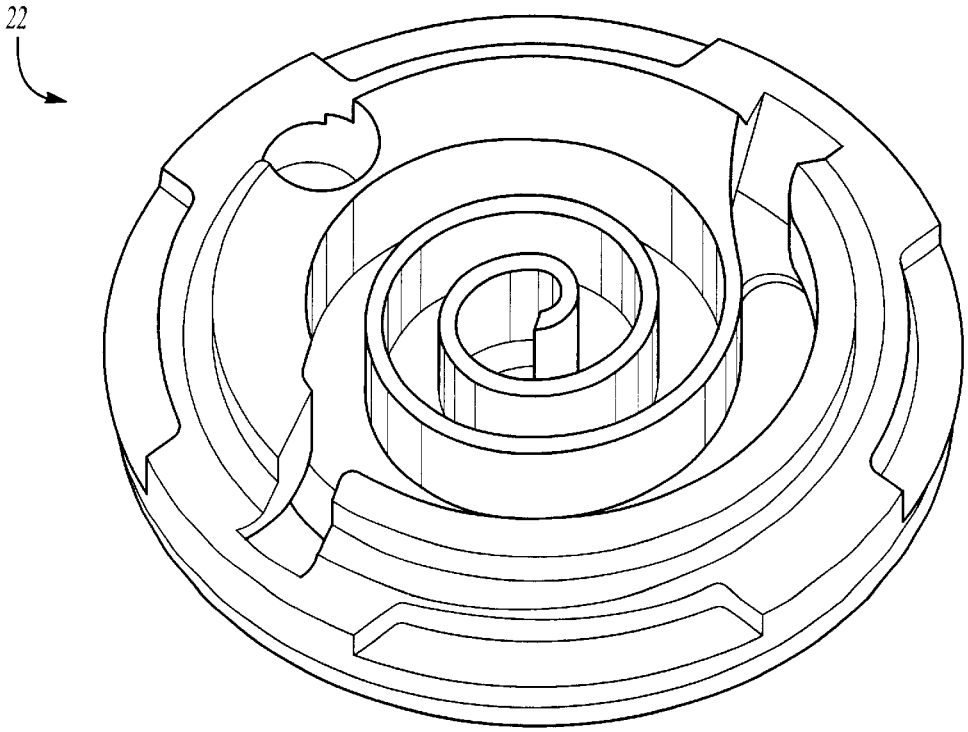
FIG. 4 is a perspective view showing the non-orbiting scroll of this invention.

FIG. 4 is a perspective view of the non-orbiting scroll 22 according to this invention. As shown, passages 34 and 36 extend as described above.

Although the embodiments preferably have the passages formed into the nonorbiting scroll, it is also possible that the suction passages could be formed within the orbiting scroll. These passages could be formed with a lost foam or wax technique.

A preferred embodiment of this invention has been disclosed, however, a worker of this art would recognize that many modifications would come within the scope of this invention. For that reason the following claims should be studied to determine the true scope and content of this invention.

What is claimed is:

1. A scroll compressor comprising:

a first scroll member having a base and generally spiral wrap extending from said base;

a second scroll member having a base and a generally spiral wrap extending from its base, said second scroll member being driven to orbit relative to said first scroll member, and said first and second scroll member wraps interfitting to define compression chambers;

a base of said second scroll member and a forward face of said first scroll member being in contact at an area radially outward of said scroll wrap of said first scroll member to define a thrust surface; and a pair of suction passages extending into a face of one of said first and second scroll members along said thrust surface, said suction passages having a portion merging into suction areas directly radially outward of said spiral wrap of said first scroll member at circumferentially spaced locations, and said suction passages having a direction with a substantial tangential component along a tangential direction outwardly of said spiral wrap of said first scroll member at a location at which it merges into said suction chamber.

2. A scroll compressor as recited in claim 1, wherein a first of said suction passage has a first portion along a first direction with a lesser tangential component, and a second portion with a greater tangential component such that a refrigerant is guided into a suction chamber, and a second of said suction passages spaced circumferentially inward of said first suction passage, and generally comprised of a first portion extending at a first tangential direction with a lesser tangential component and a second portion with a greater tangential component, such that a refrigerant is guided into a suction chamber.

3. A scroll compressor as recited in claim 1, wherein there are thrust surfaces formed on each circumferential side of both of said first and second suction passages.

4. A scroll compressor as recited in claim 1, wherein said suction passages extend into said face of said first scroll member.

5. A scroll compressor as recited in claim 4, wherein a base of said second scroll member closes said passage.

6. A scroll compressor as recited in claim 1, wherein the other of said first and second scrolls closes has a surface closing said passage.

* * * * *